US010477305B2

(12) United States Patent
Jung

(10) Patent No.: US 10,477,305 B2
(45) Date of Patent: Nov. 12, 2019

(54) HYDROPHOBIC AND OLEOPHOBIC MEMBRANE, AND WATERPROOF SOUND DEVICE USING SAME

(71) Applicant: AMOGREENTECH CO., LTD., Gimpo-si (KR)

(72) Inventor: Yong Sik Jung, Yongin-si (KR)

(73) Assignee: AMOGREENTECH CO., LTD., Gimpo-si (KR)

( * ) Notice: Subject to any disclaimer, the term of this patent is extended or adjusted under 35 U.S.C. 154(b) by 63 days.

(21) Appl. No.: 15/622,567

(22) Filed: Jun. 14, 2017

(65) Prior Publication Data

US 2017/0280236 A1 Sep. 28, 2017

Related U.S. Application Data

(62) Division of application No. PCT/KR2015/013889, filed on Dec. 17, 2015.

(30) Foreign Application Priority Data

Dec. 19, 2014 (KR) ..... 10-2014-0184817

(51) Int. Cl.
*H04R 1/44* (2006.01)
*H04R 7/04* (2006.01)

(52) U.S. Cl.
CPC ..... *H04R 1/44* (2013.01); *H04R 7/04* (2013.01); *H04R 2207/00* (2013.01)

(58) Field of Classification Search
CPC .. H04R 1/023; H04R 1/086; H04R 2307/025; H04R 2307/029
See application file for complete search history.

(56) References Cited

U.S. PATENT DOCUMENTS 8,194,875 B2 * 6/2012 Miranda ..... A42B 3/14 381/151
8,431,204 B2 * 4/2013 Ueki ..... H04R 1/023 156/247
9,038,773 B2 * 5/2015 Banter ..... G10K 11/002 181/286
9,510,091 B2 * 11/2016 Katsuda ..... H04R 1/02
9,811,121 B2 * 11/2017 Cardinali ..... G06F 1/1656
(Continued)

FOREIGN PATENT DOCUMENTS

JP 2006041864 2/2006
JP 2006093932 4/2006
(Continued)

OTHER PUBLICATIONS

International Search Report—PCT/KR2015/013889 dated Mar. 30, 2016.

*Primary Examiner* — Curtis A Kuntz
*Assistant Examiner* — Ryan Robinson
(74) *Attorney, Agent, or Firm* — Cantor Colburn LLP

(57) ABSTRACT

Provided is a waterproof sound device including: an acoustic unit that emits or receives sound; and a membrane that vibrates to transmit the sound emitted from the acoustic unit to the outside or to transmit sound from the outside to the acoustic unit, wherein a distance from the membrane to the acoustic unit is determined to be greater than the maximum vibration width of the width of the vibration of the membrane that vibrates toward the acoustic unit.

6 Claims, 6 Drawing Sheets

(56) References Cited

U.S. PATENT DOCUMENTS

| | | | | |
|---|---|---|---|---|
| 2003/0106294 | A1* | 6/2003 | Chung | B01D 39/086 55/486 |
| 2003/0162903 | A1* | 8/2003 | Day | B32B 5/26 525/276 |
| 2013/0108097 | A1* | 5/2013 | Neilson | H04R 25/65 381/322 |
| 2014/0060330 | A1* | 3/2014 | Boyat | H05K 5/0213 96/11 |

FOREIGN PATENT DOCUMENTS

| | | |
|---|---|---|
| KR | 20090098566 | 9/2009 |
| KR | 20100046247 | 5/2010 |
| KR | 20100130796 | 12/2010 |
| KR | 101162102 | 7/2012 |
| KR | 101370581 | 3/2014 |
| KR | 101422918 | 7/2014 |

* cited by examiner

HYDROPHOBIC AND OLEOPHOBIC MEMBRANE, AND WATERPROOF SOUND DEVICE USING SAME

CROSS-REFERENCE TO RELATED APPLICATION

This application is a divisional application of PCT Patent Application No. PCT/KR2015/013889 filed on Dec. 17, 2015, which claims priority to and the benefit of Korean Patent Application No. 10-2014-0184817 filed on Dec. 19, 2014, and the entire disclosures of which are incorporated herein by reference.

TECHNICAL FIELD

The present invention relates to a hydrophobic and oleophobic membrane and a waterproof sound device using the membrane. More particularly, the present invention relates to a hydrophobic and oleophobic membrane capable of maximizing water-repellent and oil-repellent characteristics and improving sound transfer performance, and a waterproof sound device using the membrane.

BACKGROUND ART

Generally, a sound device refers to a device from which sound is output, or a device to which sound is input.

Such sound devices are applied in various industrial fields such as computers, mobile electronic devices, medical equipment, and the like.

In recent years, mobile electronic devices such as portable terminals, digital cameras, notebooks, and the like are required to be waterproof sound devices capable of emitting or inputting sound while preventing water or dust from permeating into mobile electronic devices due to portability.

Meanwhile, a waterproof sound device is provided with a membrane that vibrates in order to transmit sound, and the performance of the waterproof sound device depends on the characteristics of the membrane, and thus development of an excellent membrane is required.

Korean Patent Application Publication No. 10-2009-0098566 discloses a method of manufacturing a hydrophilic and hydrophobic membrane, the method comprising: a template preparing step of preparing a template having fine holes formed on an outer surface thereof; a polymer material applying step of applying a polymer material to a predetermined pattern region on an outer surface of the template; a film attaching step of attaching a hydrophilic film to an outer surface of the template; and a template removing step of separating and removing the template from the hydrophilic film.

However, in Korean Patent Application Publication No. 10-2009-0098566, the template is removed to form nano-sized pillars in the polymer material, and the area where the nano-sized pillars are formed becomes a hydrophobic surface with minimal wettability. Therefore, there is a problem that the effective water repellency of the entire membrane is deteriorated because a technique of forming hydrophobicity only on the surface of the polymer material of the membrane is disclosed.

Korean Patent Application Publication No. 10-2010-0130796 discloses a technique of attaching a waterproof Gore-Tex (registered trademark of W. L. Gore and Associates) tape to a sound transmission hole of a cellular phone case to impart a waterproof function. However, this waterproof Gore-Tex tape which performs a waterproof function is attached to the cellular phone case. Therefore, there is a disadvantage that sound transmitted to the outside from the sound transmission hole or sound transmitted from the outside to the sound transmission hole is not smoothly transmitted.

Korean Patent Application Publication No. 10-2010-0046247 discloses an electroacoustic transducer including a case, a vibrating body provided in the case, a sound transmission hole and a sound transmission test hole formed in the case, and a waterproof film covering the sound transmission hole.

The waterproof membrane of Korean Patent Application Publication No. 10-2010-0046247 is also mounted on a frame having a sound transmission opening portion, and thus there is a problem that a sound transmission function is deteriorated.

DISCLOSURE

Technical Problem

Accordingly, the present invention has been made keeping in mind the above problems occurring in the prior art, and it is an object of the present invention to provide a hydrophobic and oleophobic membrane capable of exhibiting water repellency and oil repellency in the whole area and maximizing water repellent and oil repellent characteristics.

It is another object of the present invention to provide a waterproof sound device capable of improving the sound transmission performance by constituting a membrane that does not contact a pass unit or an acoustic unit by vibration.

It is still another object of the present invention to provide a waterproof sound device capable of maximizing water repellency and oil repellency by forming a membrane by using nanofibers containing a water repellent and oil repellent agent, thereby exhibiting water repellent and oil repellent characteristics in the whole area including a cut surface of the membrane, and thus maximizing water repellency and oil repellency.

Technical Solution

In order to achieve the above-mentioned object, according to an embodiment of the present invention, there is provided a hydrophobic and oleophobic membrane comprising: a structure that is formed by accumulating nanofibers that are formed by electrospinning a spinning solution that is formed by mixing a water-repellent and oil-repellent agent, a solvent, and a polymer material.

Here, at least one of a nonwoven fabric, a nanofiber web having pores, and a fabric may be further laminated on the structure.

The water-repellent and oil-repellent agent may be a liquid-phase or solid-phase water-repellent and oil-repellent agent dissolved or not dissolved in the solvent.

The powder or filler of the water-repellent and oil-repellent agent may be dispersed in the nanofibers, and the diameter of each of the nanofibers may be 0.1 μm to 2 μm.

Further, the structure may be a structure in which a plurality of pores are formed or a structure of a non-pore state in which no pores are formed. Here, the size of each of the pores may be 2 μm or less.

In addition, water repellency and oil repellency can be revealed in the X, Y, and Z directions of the structure, and a cut surface of the structure can exhibit water repellency and oil repellency.

The hydrophobic and oleophobic membrane may be one of an air vent membrane, an acoustic membrane, and a diaphragm membrane.

According to an aspect of the present invention, there is provided a waterproof sound device comprising: an acoustic unit that emits or receives sound; and a membrane that vibrates to transmit the sound emitted from the acoustic unit to the outside or to transmit sound from the outside to the acoustic unit, wherein a distance from the membrane to the acoustic unit is determined to be greater than the maximum vibration width of the width of the vibration of the membrane that vibrates toward the acoustic unit.

In addition, the waterproof sound device further comprises a pass unit formed with at least one pass hole through which the sound transmitted from the membrane or the sound inputted from the outside flows.

Here, the membrane is positioned between the acoustic unit and the pass unit, and a distance from the membrane to the pass unit may be greater than the maximum vibration width of the membrane in the direction of the pass unit.

In addition, the waterproof sound device may further comprise a fixing unit interposed between the membrane and the acoustic part and another fixing unit interposed between the membrane and the pass unit, and the fixing units may be a single-layer structure or a lamination structure capable of sticking or adhering and fixing therebetween In addition, the membrane may be a membrane formed of a plurality of pores or a non-pore type membrane having a waterproof and dustproof function for transmitting sound and preventing liquid and solid from flowing.

In addition, the membrane may be a hydrophobic and oleophobic membrane having a plurality of pores or in the form of a non-pore shape, and formed by accumulation of nanofibers including a water-repellent and oil-repellent agent. Here, the hydrophobic and oleophobic membrane may be formed by accumulating nanofibers obtained by electrospinning a spinning solution containing a mixture of a water-repellent and oil-repellent agent, a solvent, and a polymer material.

According to an aspect of the present invention, there is provided a waterproof sound device comprising: an acoustic unit that emits or receives sound; and a membrane that vibrates in order to transmit the sound emitted from the acoustic unit to the outside or transmit the sound inputted from the outside to the acoustic unit, wherein the membrane comprises a hydrophobic and oleophobic membrane having a plurality of pores or in the form of a non-pore shape, and formed by accumulating nanofibers obtained by electrospinning a spinning solution containing a mixture of a water-repellent and oil-repellent agent, a solvent, and a polymer material.

A sound transmission area of the membrane may be larger than a sound emission or input area of the acoustic unit.

Advantageous Effects

According to the present invention, since the nanofiber constituting the hydrophobic and oleophobic membrane includes a water-repellent and oil-repellent agent, there are advantages that the water-repellent and oil-repellent property can be expressed in the entire region including the cut surface of the membrane.

According to the present invention, both the front and rear surfaces of the hydrophobic and oleophobic membrane can exhibit water-repellent and oil-repellent properties without further post-treatment on the nanofiber formed by electrospinning a spinning solution, and can improve the resisting water pressure.

According to the present invention, a hydrophobic and oleophobic membrane is produced by accumulating nanofibers formed by electrospinning a spinning solution containing a mixture of a water-repellent and oil-repellent agent, a solvent, and a polymer material, so that the remaining amount of the water-repellent and oil-repellent agent is not produced to thus prevent the discharge of environmental pollutants caused by treatment of the remaining amount of the water-repellent and oil-repellent agent.

According to the present invention, the distance from the membrane to the acoustic unit and/or the distance from the membrane to the pass unit is made larger than the maximum vibration width of the membrane so that the membrane is not brought into contact with the pass unit or the acoustic unit by vibration, to thereby prevent degradation of sound transmission performance.

According to the present invention, since the nanofiber constituting the membrane of the waterproof sound device includes a water-repellent and oil-repellent agent, there are advantages that the water-repellent and oil-repellent property can be expressed in the entire region including the cut surface of the membrane.

According to the present invention, the waterproof sound device can allow the membrane to have non-pores or micro pores and thus perform a function of smoothly transmitting sound and preventing liquids and foreign substances from passing therethrough.

BEST MODE

Hereinafter, embodiments of the present invention will be described in detail with reference to the accompanying drawings.

Figure 1:
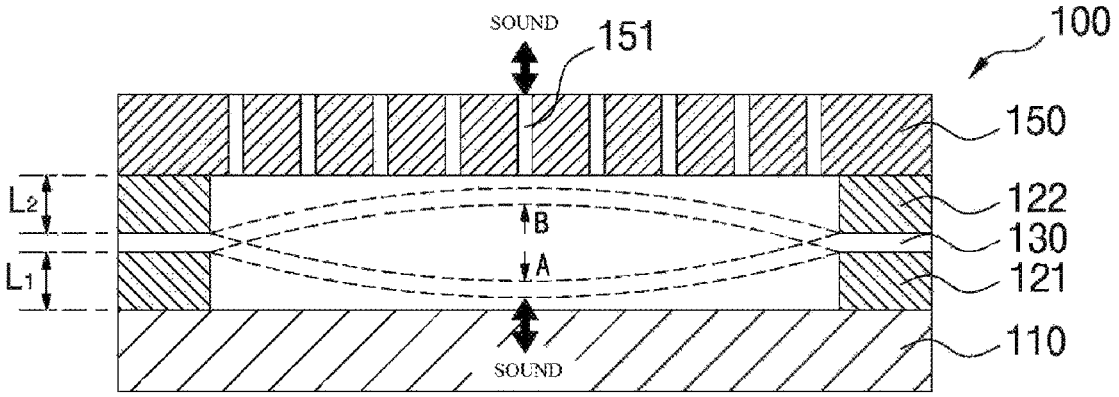
FIG. 1 is a cross-sectional view for explaining a waterproof sound device according to the present invention.

Referring to FIG. 1, a waterproof sound device 100 according to an embodiment of the present invention includes an acoustic unit 110 through which sound is emitted or inputted; and a membrane 130 vibrating to transmit the sound emitted from the acoustic unit 110 to the outside or to transmit the sound inputted from the outside to the acoustic unit 110, in which the distance $L_1$ between the membrane 130 and the acoustic unit 110 is greater than the maximum vibrating width, that is, the maximum amplitude A of the membrane 130 vibrating in the direction of the acoustic unit 110.

Here, the waterproof sound apparatus 100 may further include a pass unit 150 formed with at least one pass hole 151 through which the sound transmitted from the membrane 130 or the sound input from the outside flows.

In this case, the membrane 130 is preferably located between the acoustic unit 110 and the pass unit 150, and the distance $L_2$ from the membrane 130 to the pass unit 150 is preferably greater than the maximum vibrating width, that is, the maximum amplitude B of the membrane 130 vibrating in the direction of the pass unit 150.

As described above, the membrane 130 is assembled with the acoustic unit 110 and the pass unit 150 so that the distance $L_1$ from the membrane 130 to the acoustic unit 110 is greater than the maximum vibrating width, that is, the maximum amplitude A of the membrane 130 vibrating in the direction of the acoustic unit 110, and the distance $L_2$ from the membrane 130 to the pass unit 150 is greater than the maximum vibrating width, that is, the maximum amplitude B of the membrane 130 vibrating in the direction of the pass unit 150 and thus the membrane 130 is not contact with the acoustic unit 110 or the pass unit 150 due to vibration to thereby prevent the sound transmission performance from deteriorating.

That is, in the waterproof sound device 100 according to the embodiment of the present invention, the membrane 130 is not in contact with the acoustic unit 110 or the pass unit 150 due to vibration, to thereby improve the sound transmission capability of the external sound of the audible frequency band input from the pass unit 150 or the sound of the audio frequency band outputted from the acoustic unit 110.

Here, the membrane 130 is positioned between the acoustic unit 110 and the pass unit 150, and fixing units 121 and 122 are respectively provided between the membrane 130 and the acoustic unit 110 and between the membrane 130 and the pass unit 150, thereby fixing the membrane 130 to the acoustic unit 110 and the pass unit 150, respectively.

In this case, the fixing units 121 and 122 may be a single layer structure or a lamination structure which can be fixed or adhered to the membrane 130 in FIG. 1, and the fixing units 121 and 122 may be formed to have a thickness not to be in contact with the acoustic unit 110 and the pass unit 150 by the vibration of the membrane 130.

Meanwhile, the membrane 130 can transmit sound by vibration or pores. For example, when the membrane 130 transmits sound by vibration, the vibration area of the membrane 130 becomes the sound transmission area.

The acoustic unit 110 may be a speaker or a receiver that generates and emits sound, or may be a microphone to which an external sound is input.

The membrane 130 is vibrated by the pressure of the sound emitted from the acoustic unit 110 or the pressure of the sound inputted from the outside through the pass holes 151 of the pass unit 150, to thereby transmit substantially the same sound as the sound emitted from the acoustic unit 110 or the sound inputted from the outside through the pass holes 151 of the pass unit 150 to the acoustic unit 110 or the pass holes 151.

Here, the membrane 130 may be a membrane formed of a plurality of pores or a non-pore type membrane having a waterproof and dustproof function for transmitting sound and preventing liquid and solid from flowing.

In this case, a membrane formed of a plurality of pores or a non-pore type membrane is a nanofiber web formed by accumulating nanofibers that are obtained by electrospinning of a spinning solution, wherein the diameter of each of the nanofibers is 0.1 μm to 2 μm, and the size of each of the pores in the membrane formed of a plurality of pores may be preferably 2 μm or less, and the porosity is preferably set to 20% to 90%.

In some embodiments of the present invention, as described later, a hydrophobic and oleophobic membrane having a large number of pores or a non-pore shape and formed by accumulation of nanofibers including water-repellent and oil-repellent agents, can be used.

The operation of the waterproof sound device 100 according to the embodiment of the present invention will follow. First, when sound is emitted from the acoustic unit 110, the sound emitted from the acoustic unit 110 vibrates the membrane 130 to thus transmit substantially the same sound as that of the acoustic unit 110 to the pass holes 151 of the pass unit 150, and output the transmitted sound to the outside through the pass holes 150.

Secondly, when external sound is input to the acoustic unit 110, the external sound is input to the waterproof sound device 100 through the pass holes 151 of the pass unit 150, to then vibrate the membrane 130 to thus transmit substantially the same sound as the external sound to the acoustic unit 110.

Here, the membrane 130 vibrates up and down to transmit sound.

Figure 2:
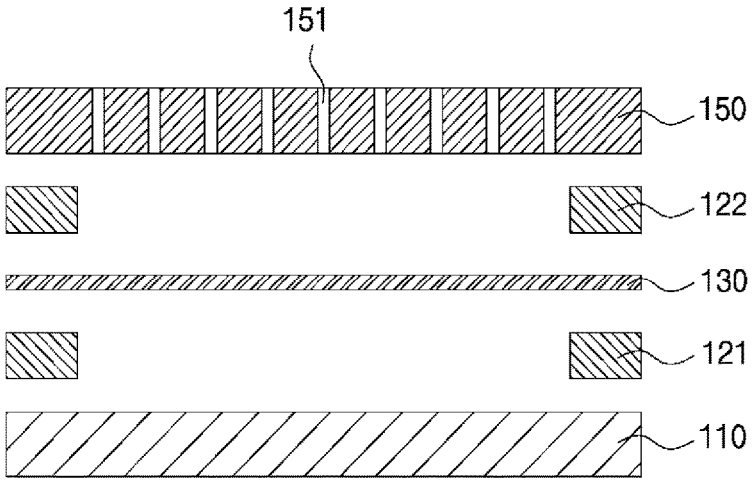
FIG. 2 is a conceptual exploded cross-sectional view for explaining a method of assembling an example of a waterproof sound device according to the present invention.
Figure 3:
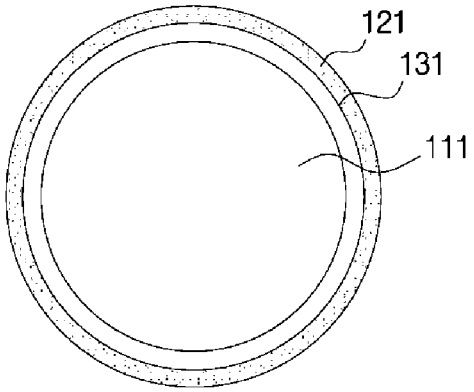
FIG. 3 is a conceptual plan view for explaining a state in which an adhesive film applied to a waterproof sound device according to the present invention is adhered to an acoustic unit.

FIG. 2 is a conceptual exploded cross-sectional view for explaining a method of assembling an example of a waterproof sound device according to the present invention, and FIG. 3 is a conceptual plan view for explaining a state in which an adhesive film applied to a waterproof sound device according to the present invention is adhered to an acoustic unit.

Referring to FIG. 2, a waterproof sound device according to an embodiment of the present invention includes a first adhesive film 121 between an acoustic unit 110 and a membrane 130, and a second adhesive film 122 between the membrane 130 and a pass unit 150 and thus can be formed by assembling the acoustic unit 110 and the membrane 130 with the first adhesive film 121 and the membrane 130 and the pass unit 150 with the second adhesive film 122. It is preferable that the first and second adhesive films 121 and 122 are fixing units and used as a double-sided cohesive or adhesive tape. In addition to the adhesives such as the adhesive films, a material such as a poron, a PET (polyethylene terephthalate), a PC (polycarbonates), a silicone, or the like may be stacked together between the acoustic part 110 and the membrane 130 and between the membrane 130 and the pass unit 150.

The first and second adhesive films 121 and 122 not only perform an adhesive function for assembly but also adhere to both sides of the membrane 130 to define a sound transmission area of the membrane 130.

That is, the first and second adhesive films 121 and 122 are adhered to the corresponding positions of both sides of the membrane 130, so that the area of the membrane 130 where the first and second adhesive films 121 and 122 are not bonded, becomes a vibration area.

In addition, as shown in FIG. 3, when the first adhesive film 121 is adhered to the acoustic unit 110, the inner surface 131 of the first adhesive film 121 is a vibration area boundary surface of the membrane, and the area of the acoustic unit 110 spaced inward from the inner surface 131 of the first adhesive film 121 becomes a sound emission or input area 111 of the acoustic unit 110.

Therefore, in some embodiments of the present invention, the first adhesive film 121 is adhered to the area spaced outwardly from the sound emission or input area 111 of the acoustic unit 110.

As described above, in some embodiments of the present invention, the waterproof sound device can be assembled such that the sound transmission area of the membrane is larger than the sound emission or the input area of the acoustic unit.

Figure 4:
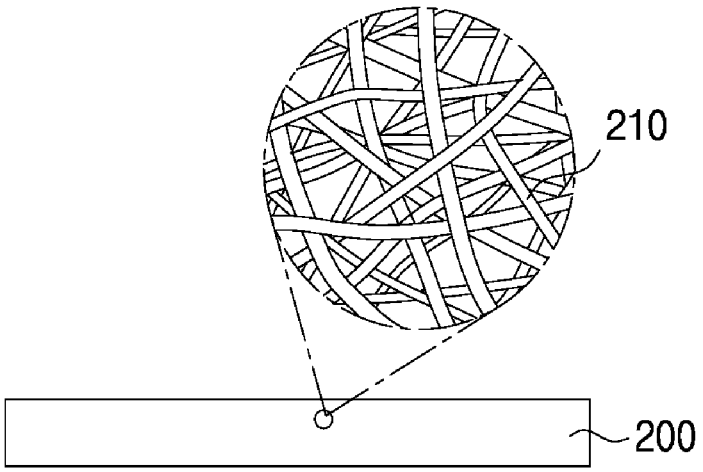
FIG. 4 is a view for explaining a hydrophobic and oleophobic membrane applicable to a waterproof sound device according to the present invention.

FIG. 4 is a view for explaining a hydrophobic and oleophobic membrane applicable to a waterproof sound device according to the present invention.

Referring to FIG. 4, the hydrophobic and oleophobic membrane 200 has a structure that is formed by accumulating nanofibers obtained by electrospinning a spinning solution containing a mixture of a water-repellent and oil-repellent agent, a solvent, and a polymer material.

Here, the structure may be a nanofiber web structure with pores (sometimes referred to as a nonwoven webs structure).

The hydrophobic and oleophilic membrane 200 according to the embodiment of the present invention is implemented with a structure in which a plurality of pores are formed by the accumulated nanofibers 210 as shown in the enlarged view of FIG. 4.

In some embodiments of the present invention, when preparing a spinning solution by mixing a water-repellent and oil-repellent agent, a solvent and a polymer material, the water-repellent and oil-repellent agent is mixed in a state in which it is not dissolved in a solvent or dissolved in a solvent. That is, in the spinning solution for forming the hydrophobic and oleophilic membrane 200, the water-repellent and oil-repellent agent is either not dissolved in the solvent or remains dissolved in the solvent.

Here, the water-repellent and oil-repellent agent may be a liquid type, or a solid type such as powder, pellet, etc.

Meanwhile, a polymer solution is formed by dissolving a polymer material in a solvent. The polymer material usable in the present invention is not particularly limited as long as it is a resin that can be dissolved in a solvent for electrospinning and is capable of forming nanofibers by electrospinning. For example, the polymer material may include: polyvinylidene fluoride (PVdF), poly (vinylidene fluoride-co-hexafluoropropylene), perfluoropolymers, polyvinyl chloride or polyvinylidene chloride, and co-polymers thereof polyethylene glycol derivatives containing polyethylene glycol dialkylether and polyethylene glycol dialkyl ester; polyoxide containing poly (oxymethylene-oligo-oxyethylene), polyethylene oxide and polypropylene oxide; polyacrylonitrile co-polymers containing polyvinyl acetate, poly (vinyl pyrrolidone-vinyl acetate), polystyrene, polystyrene acrylonitrile co-polymers, polyacrylonitrile (PAN), and polyacrylonitrile methyl methacrylate co-polymers; and polymethyl methacrylate and polymethyl methacrylate co-polymers, and a mixture thereof.

The solvent may employ at least one selected from the group consisting of DMAc (N, N-dimethyl acetoamide), DMF (N, N-dimethylformamide), NMP (N-methyl-2-pyrrolidinone), DMSO (dimethyl sulfoxide), THF (tetra-hydrofuran), EC (ethylene carbonate), DEC (diethyl carbonate), DMC (dimethyl carbonate), EMC (ethyl methyl carbonate), PC (propylene carbonate), water, acetic acid, formic acid, chloroform, dichloromethane, acetone, and isopropylalchol.

In addition, the hydrophobic and oleophobic membrane 200 can determine the number of pores and the average diameter of the pores according to the thickness, thereby making the membrane having various characteristics.

The hydrophobic and oleophobic membrane 200 is preferably used alone, but may be laminated with a nonwoven fabric to reinforce the strength. The nonwoven fabric may be, for example, any one of a nonwoven fabric made of PP/PE fibers of a double structure where PE is coated on an outer periphery of a PP fiber as a core, a PET nonwoven fabric made of polyethylene terephthalate (PET) fibers, and a nonwoven fabric made of cellulose fibers.

Therefore, according to the present invention, both the front and rear surfaces of the hydrophobic and oleophobic membrane can exhibit water-repellent and oil-repellent properties without further post-treatment on the nanofibers formed by electrospinning the spinning solution, and can improve the resisting water pressure.

Figure 5A:
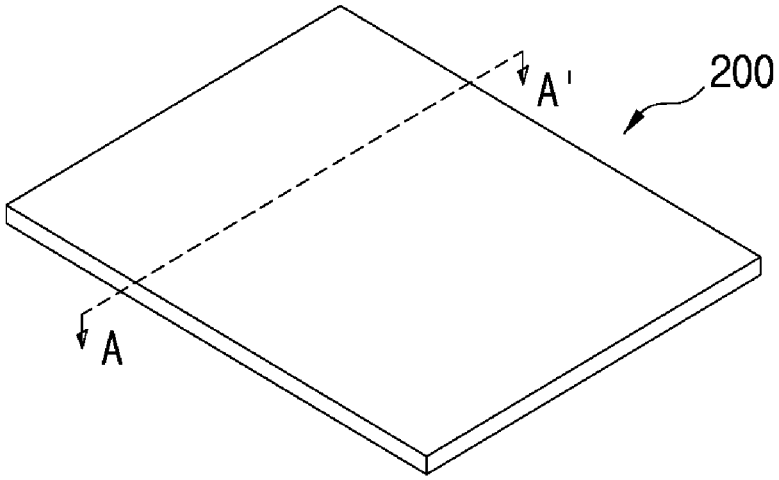
FIGS. 5A and 5B illustrate hydrophobic and oleophobic membranes according to the present invention.
Figure 5B:
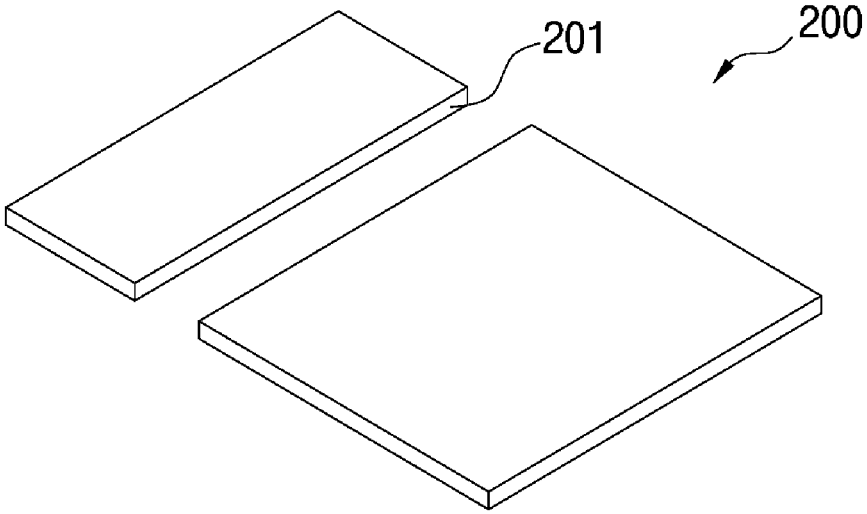

FIGS. 5A and 5B illustrate hydrophobic and oleophobic membranes according to the present invention.

As described above, the hydrophobic and oleophobic membrane 200 according to the present invention is formed by accumulating nanofibers containing water-repellent and oil-repellent agents.

Therefore, according to the present invention, since the nanofiber constituting the hydrophobic and oleophobic membrane includes a water-repellent and oil-repellent agent, there are advantages that the water-repellent and oil-repellent property can be expressed in the entire region, thereby maximizing the water-repellency and oil-repellency.

In other words, as shown in FIG. 5A, the hydrophobic and oleophilic membrane 200 according to the embodiment of the present invention can be realized as a flat plate shape, and can exhibit water repellency and oil repellency in the X, Y, and Z directions of the flat plate shaped membrane.

In addition, the hydrophobic and oleophilic membrane 200 according to the embodiment of the present invention can exhibit water repellency and oil repellency even on the cut surface.

For example, when the hydrophobic and oleophilic membrane 200 is cut along a line A-A' in FIG. 5A, the water-repellent and oil-repellent property also appears on the cut surface 201 of the hydrophobic and oleophilic membrane 200 as shown in FIG. 5B.

Figure 6:
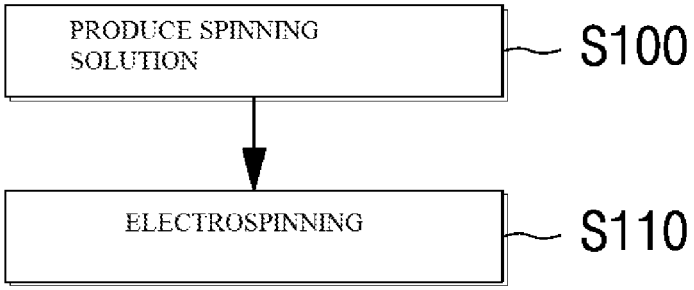
FIG. 6 is a flowchart for explaining a method of manufacturing a hydrophobic and oleophobic membrane applied to a waterproof sound device according to the present invention.
Figure 7:
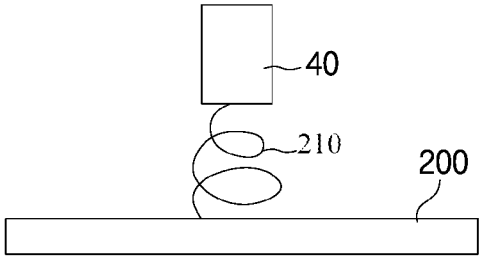
FIG. 7 is a schematic view of an electrospinning apparatus for explaining nanofibers formed by electrospinning a spinning solution applied to a waterproof sound device according to the present invention.
Figure 8:
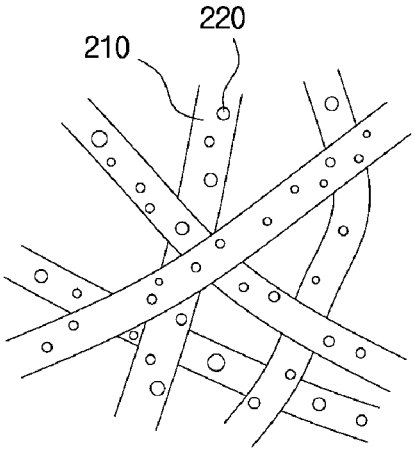
FIG. 8 is a schematic view for explaining distribution of the water-repellent and oil-repellent agent powders on the nanofibers of the hydrophobic and oleophobic membrane applied to the waterproof sound device according to the present invention.

FIG. 6 is a flow chart of a method of manufacturing a hydrophobic and oleophobic membrane applied to a waterproof sound device according to the present invention, FIG. 7 is a schematic view of an electrospinning apparatus for explaining nanofibers formed by electrospinning a spinning solution applied to a waterproof sound device according to the present invention, and FIG. 8 is a schematic view for explaining distribution of the water-repellent and oil-repellent agent powders on the nanofibers of the hydrophobic and oleophobic membrane applied to the waterproof sound device according to the present invention.

Referring to FIG. 6, a method for producing a hydrophobic and oleophobic membrane according to an embodiment of the present invention includes first preparing a spinning solution by mixing a polymer material, a water-repellent oil-repellent agent, and a solvent (S100).

The polymer material that can be dissolved in a solvent may be used, and the water-repellent and oil-repellent agent that can be either dissolved in a solvent or not dissolved may be used.

Here, the water-repellent and oil-repellent agent may be a liquid type, or a solid type such as powder or pellet.

Thereafter, the spinning solution is electrospun to accumulate the nanofibers including the water-repellent and oil-repellent agent to form a hydrophobic and oleophilic membrane (S110).

Here, the spinning solution is electrospun from a spinning nozzle 40 of an electrospinning apparatus described later. As shown in FIG. 7, the nanofibers 210 are discharged from the spinning nozzle 40, and the discharged nanofibers 210 are accumulated. As a result, the hydrophobic and oleophobic membrane 200 is formed.

Here, it is difficult to distinguish the water-repellent and oil-repellent agent from the polymer material in the case of the hydrophobic and oleophobic membrane that is formed by accumulating the nanofibers made by electrospinning the spinning solution in which the water-repellent and oil-repellent agent and the polymer material are dissolved in the solvent, but it is possible to distinguish the water-repellent and oil-repellent agent from the polymer material in view of the structural characteristics in the case of the hydrophobic and oleophobic membrane that is formed by accumulating the nanofibers made by electrospinning the spinning solution in which the polymer material is dissolved in the solvent, and the water-repellent and oil-repellent agent is not dissolved in the solvent.

That is, as shown in FIG. 8, the powders or fillers 220 of the water repellent and oil repellent agent are dispersed in the nanofibers 210 of the hydrophobic and oleophobic membrane.

As described above, since the pores of the hydrophobic and oleophobic membrane embodied by the manufacturing method are present between the accumulated nanofibers, the hydrophobic and oleophobic membrane can have micro pores, so that the hydrophobic and oleophobic membrane allows sound to smoothly pass and prevents the liquid or foreign matters from passing therethrough.

In addition, in the case of the method of manufacturing the hydrophobic and oleophobic membrane, the hydrophobic and oleophobic membrane is formed by accumulating the nanofibers made by electrospinning the spinning solution that is formed by mixing the water-repellent and oil-repellent agent, the solvent, and the polymer material. Accordingly, the remaining amount of the water-repellent and oil-repellent agent is not produced to thus prevent the discharge of environmental pollutants caused by treatment of the remaining amount of the water-repellent and oil-repellent agent.

Figure 9:
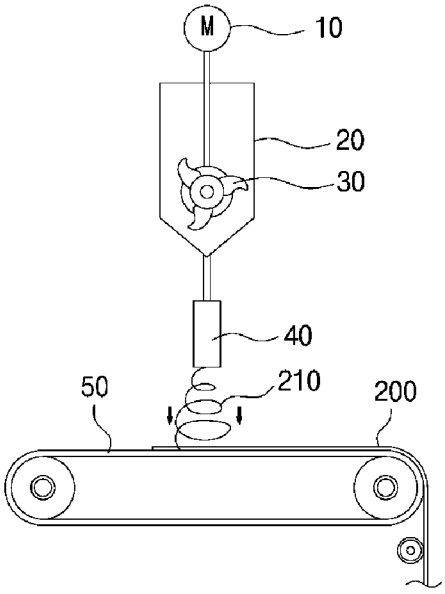
FIG. 9 is a schematic view for explaining an electrospinning apparatus for manufacturing a membrane applied to a waterproofing sound device according to the present invention.

FIG. 9 is a schematic view for explaining an electrospinning apparatus for manufacturing a membrane applied to a waterproofing sound device according to the present invention.

Referring to FIG. 9, the electrospinning apparatus applied in the present invention is provided with a stirring tank 20 connected to a spinning nozzle 40 for feeding a stirred spinning solution. A grounded collector 50 in the form of a conveyor moving at a speed is arranged in the lower portion spaced apart from the spinning nozzle 40, and the spinning nozzle 40 is connected to a high voltage generator (not shown).

In order to produce a hydrophobic and oleophobic membrane by using such an electrospinning apparatus, a polymer material, a water-repellent and oil-repellent agent, and a solvent are added to a glass beaker and mixed with a stirrer 30 that is driven by a motor 10, to prepare a spinning solution.

Then, when the high-voltage electrostatic force is applied between the collector 50 and the spinning nozzle 40, after putting the spinning solution into the stirring tank 20, the spinning nozzle 40 turns the spinning solution into ultra-fine nanofibers 210 to then be spun on the collector 50, and the nanofibers 210 are accumulated in the collector 50 to form the hydrophobic and oleophobic membrane 200.

More specifically, the spinning solution discharged from the spinning nozzle 40 is discharged as the nanofibers 210 while passing through the spinning nozzle 40 charged by the high voltage generator, and the nanofibers are sequentially laminated on the grounded collector 50 provided in the form of a conveyor moving at a speed to form a hydrophobic and oleophobic membrane.

Figure 10:
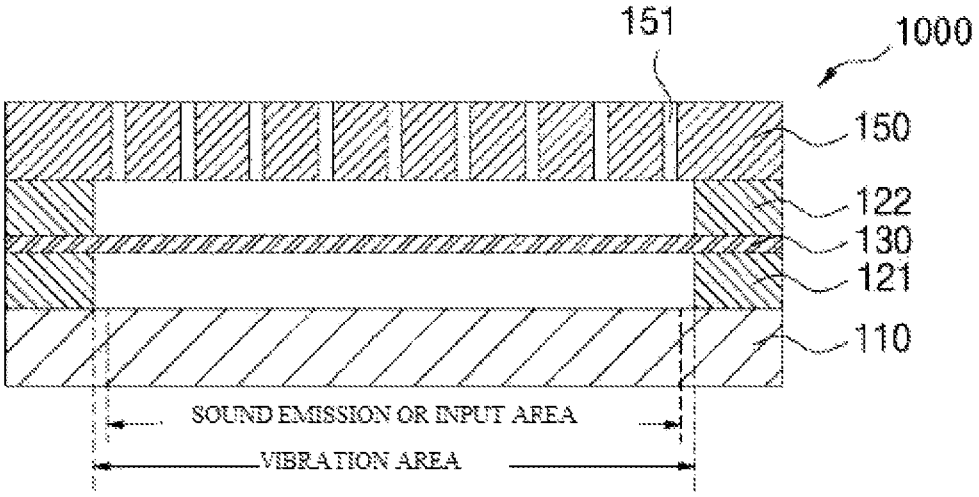
FIG. 10 is a cross-sectional view of a waterproof sound device according to another embodiment of the present invention.

Referring to FIG. 10, a waterproof sound device 1000 according to another embodiment of the present invention includes an acoustic unit 110 from which sound is emitted or to which sound is inputted; and a membrane 130 vibrating to transmit the sound emitted from the acoustic unit 110 to the outside or to transmit the sound inputted from the outside to the acoustic unit 110, wherein a sound transmission area of the membrane 130 is larger than a sound emission or input area of the acoustic unit 110.

As described above, in some embodiments of the present invention, a sound transmission area of the membrane 130 is designed to be larger than a sound emission area of the acoustic unit 110 (or a vibration area of the acoustic unit 110, to thereby reduce the sound transmission loss so that the sound transmission performance can be improved.

Meanwhile, the membrane 130 can transmit sound by vibration or pores. For example, when the membrane 130 transmits sound by vibration, the vibration area of the membrane 130 becomes the sound transmission area.

While the present invention has been particularly shown and described with reference to exemplary embodiments thereof, by way of illustration and example only, it is clearly understood that the present invention is not to be construed as limiting the present invention, and various changes and modifications may be made by those skilled in the art within the protective scope of the invention without departing off the spirit of the present invention.

INDUSTRIAL APPLICABILITY

The present invention is applied to a hydrophobic and oleophobic membrane and a waterproof sound device using the hydrophobic and oleophobic membrane capable of maximizing the water-repellent and oil-repelling property and improving the sound transmission performance.

What is claimed is:

1. A waterproof sound device comprising:

an acoustic unit;

a pass unit having at least one pass hole;

a waterproof membrane positioned between the acoustic unit and the pass unit, the waterproof membrane vibrating to transmit first sound emitted from the acoustic unit to outside of a waterproof sound device through the at least one pass hole or to transmit second sound received through the at least one pass hole from the outside to the acoustic unit, a first fixing unit interposed between the waterproof membrane and the acoustic unit, directly attached to the waterproof membrane and the acoustic unit, and having a first thickness to provide a first distance from the waterproof membrane to the acoustic unit, the first thickness being greater than a first maximum vibration width of the waterproof membrane toward the acoustic unit, and a second fixing unit interposed between the waterproof membrane and the pass unit, directly attached to the waterproof membrane and the pass unit, and having a second thickness to provide a second distance from the waterproof membrane to the pass unit, the second thickness being greater than a second maximum vibration width of the waterproof membrane toward the pass unit.

2. The waterproof sound device of claim 1, wherein the first and second fixing units are a single-layer structure or a lamination structure.

3. The waterproof sound device of claim 1, wherein the waterproof membrane is a membrane having a plurality of pores or no pore, and having a dustproof function.

4. The waterproof sound device of claim 1, wherein the waterproof membrane is a hydrophobic and oleophobic membrane having a plurality of pores or no pore.

5. The waterproof sound device of claim 4, wherein the hydrophobic and oleophobic membrane is formed by accumulating nanofibers obtained by electrospinning a spinning solution containing a mixture of a water-repellent and oil-repellent agent, a solvent, and a polymer material.

6. The waterproof sound device of claim 1, wherein the waterproof membrane is a non-pore membrane.

* * * * *